US006322340B1

(12) United States Patent
Itoh et al.

(10) Patent No.: US 6,322,340 B1
(45) Date of Patent: Nov. 27, 2001

(54) SCROLL COMPRESSOR HAVING A DIVIDED ORBITING SCROLL END PLATE

(75) Inventors: Takahide Itoh, Nagoya; Hisao Mizuno, Nishi-kasugai-gun, both of (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/588,572

(22) Filed: Jun. 7, 2000

(30) Foreign Application Priority Data

Jun. 8, 1999 (JP) ..... 11-161690

(51) Int. Cl.[7] ..... F04C 18/04
(52) U.S. Cl. ..... 418/55.2; 418/55.4; 418/55.5
(58) Field of Search ..... 418/55.2, 55.4, 418/55.5, 57

(56) References Cited

U.S. PATENT DOCUMENTS

| | | | |
|---|---|---|---|
| 4,993,928 | 2/1991 | Fraser, Jr. | 418/55.4 |
| 5,044,904 | 9/1991 | Richardson, Jr. | 418/55.2 |
| 5,088,906 | 2/1992 | Richardson, Jr. | 418/55.2 |
| 5,593,295 | 1/1997 | Hill | 418/55.2 |

FOREIGN PATENT DOCUMENTS

| | | | |
|---|---|---|---|
| 196 42 798 | 11/1997 | (DE) . | |
| 57-68579 | 4/1982 | (JP) . | |
| 1-44911 | 10/1989 | (JP) . | |
| 3-138474 | 6/1991 | (JP) . | |
| 3-138475 | 6/1991 | (JP) . | |
| 5-149270 | 6/1993 | (JP) . | |
| 59-79091 * | 5/1984 | (JP) | 418/55.2 |
| WO 95/12759 | 5/1995 | (WO) . | |

* cited by examiner

*Primary Examiner*—John J. Vrablik
(74) *Attorney, Agent, or Firm*—Oblon, Spivak, McClelland, Maier & Neustadt, P.C.

(57) ABSTRACT

The present invention has as an object providing a scroll compressor that transmits rotation of the eccentric axle side end plate of the orbiting scroll to the involute wrap side end plate with good efficiency, and sufficiently presses the involute wrap side end plate continuously against the fixed scroll without causing friction with the seal member; in order to attain this object, the present invention provides a scroll compressor providing a fixed scroll comprising an end plate and an involute wrap provided on one face of the end plate, and an orbiting scroll comprising and end plate, an engagement part provided on one face of the end plate and accommodating an eccentric axle therein, and an involute wrap provided on the other face of the end plate and forming a plurality of compression chambers by the combination with the involute wrap of the fixed scroll, wherein the end plate of the orbiting scroll is divided along the axial direction thereof into an involute wrap side end plate providing an involute wrap and an eccentric axle side end plate providing the engagement part, and furthermore, wherein a transmission mechanism is provided that permits movement of this involute wrap side end plate in the axial direction with respect to the eccentric axle side end plate but prevents movement in the radial or peripheral directions, and transmits the orbital movement of the eccentric axle side end plate to the involute wrap side end plate.

10 Claims, 6 Drawing Sheets

TO RADIATOR
1
1f
38
16
34
12
2
35
21c
10
21a
8
21b
14
27
13a
17
13b
18
11
A
52
9
27a
15
22
19
1A
23
24
3
6
4
30
26
25
5b
32b
32a
28c
28b
28a
28
7
32
5

SCROLL COMPRESSOR HAVING A DIVIDED ORBITING SCROLL END PLATE

BACKGROUND OF THE INVENTION

1. Field of the Invention

The present invention relates to a scroll compressor, and in particular to a scroll compressor suitable for a vapor compression refrigerating cycle that uses a refrigerant having the supercritical region of carbon dioxide ($CO_2$), for example.

2. Description of the Related Art

Recently, a refrigeration cycle using carbon dioxide (referred to hereinbelow as a "carbon dioxide cycle") as a working gas (refrigerant gas) has been proposed, for example, in Japanese Examined Patent Application, Second Publication, No. Hei 7-18602, as one measure for eliminating the use of Freon (dichlorofluoromethane) as a refrigerant in the vapor compression-type refrigerating cycle. This carbon dioxide cycle is identical to the conventional vapor compression-type refrigerating cycle that uses Freon. That is, as shown by A-B-C-D-A in FIG. 5, which shows a carbon dioxide Mollier chart, the carbon dioxide in the gaseous phase is compressed by a compressor (A-B), and this gas-phase carbon dioxide that has been compressed to a high temperature is cooled in a radiator, such as a gas cooler (B-C). Next, the carbon dioxide is decompressed using a decompressor (C-D), the carbon dioxide that has changed to a liquid phase is vaporized (D-A), and an external fluid such as air is cooled by removing its latent heat of vaporization.

However, the critical temperature of carbon dioxide is about 31°, which is low compared to the critical temperature of Freon, the conventional refrigerant. When the external temperature is high, during summer, for example, the temperature of carbon dioxide on the radiator side is higher than its critical temperature. This means that the carbon dioxide does not condense at the radiator outlet side. In FIG. 5, this is shown by the fact that the line BC does not cross the saturated liquid line SL. In addition, the state on the radiator output side (point C) is determined by the discharge pressure of the compressor and the temperature of the carbon dioxide at the radiator outlet side. Moreover, the temperature of the carbon dioxide at the radiator outlet side is determined by the radiating capacity of the radiator and the temperature of the uncontrollable external air. Due to this, the temperature at the radiator outlet cannot be substantially controlled. Therefore, the state of the radiator outlet side (point C) can be controlled by the discharge pressure of the compressor, that is, the pressure on the radiator outlet side. This means that in order to guarantee sufficient refrigerating capacity (difference in enthalpy) when the temperature of the external air is high, during summer, for example, as shown by E-F-G-H-E, the pressure on the radiator output side must be high. In order to attain this, the operating pressure of the compressor must be high in comparison to the refrigeration cycle used with conventional Freon. In the case of an air conditioning device for an automobile, for example, the operating pressure of the compressor when using Freon (Trademark R134) is about 3 kg/cm$^2$, while in contrast, this pressure must be raised to about 40 kg/cm$^2$ for carbon dioxide. In addition, the operation stopping pressure when using Freon (Trademark R134) is about 15 kg/cm$^2$, while in contrast it must be raised to about 100 kg/cm$^2$ for carbon dioxide.

Below, referring to FIG. 6, a typical scroll compressor as disclosed in Japanese Unexamined Patent Application, First Publication, No. Hei 5-149270, will be explained. As shown in FIG. 6, in a casing (not illustrated), a fixed scroll member 100, an orbiting scroll member 101, and an eccentric axle 102 are provided.

The fixed scroll 100 is formed by an end plate 100*a* providing a discharge port for discharging the compressor working gas (not illustrated) and an involute wrap 106*b* provided on one face of this end plate 100*a*.

The orbiting scroll 101 is formed by an end plate 101*a* comprising an involute wrap side end plate 105 and an eccentric axle side end plate 106, an involute wrap 101*b* provided on the face of the involute wrap side end plate 105 facing the end plate 100*a* of the fixed scroll, and an engagement part 103 provided on the face of the eccentric axle side end plate 106 not facing the involute wrap side end plate 105, and accommodating therein the eccentric axle 102, described below. The involute compression chamber 104 is formed by installing the fixed scroll 100 and the orbiting scroll 101 in the casing such that the involute wrap 100*b* of the fixed scroll 100 and the involute wrap 101*b* of the orbiting scroll 101 intermesh. Thereby, when the orbiting scroll 101 is rotated eccentrically with respect to the fixed scroll 100 by rotating the eccentric axle 102 installed in the engagement part 103, while the working gas in the casing is compressed in compression chamber 104, the working gas can be discharged from the discharge port provided on the end plate 100*a* of the fixed scroll 100.

Moreover, as explained above, a scroll compressor using carbon dioxide as a working gas requires a high revolution and pressure. Thus, there is a concern of a deterioration in capacity due to leakage of the working gas. In order to prevent this, the orbiting scroll 101 presses against the fixed scroll 100. That is, along the axial direction of the orbiting scroll 101, the end plate 100*a* thereof is divided into an involute wrap side end plate 105 providing an involute projection 10*b* and an eccentric axle side end plate 106 providing an engagement part 103. In addition, an sealed space 107 is formed between the involute wrap side end plate 105 and the eccentric axle side end plate 106. Furthermore, on the involute wrap side end plate 105, a narrow hole 108 is formed for introducing the high pressure working gas in the compression chamber 104 into the sealed space 107. Moreover, in FIG. 6, reference numeral 109 denotes a seal part for sealing the sealed space 107.

By adopting this kind of structure, one part of the high pressure working gas in the compression chamber 104 is introduced into the sealed space 107 via the narrow hole 108, and fills the sealed space 107. When comparing the upward force operating from the sealed space 107 on the involute wrap side end plate 105 and the downward force operating from the compression chamber 104 on the involute wrap side end plate 105, the upward force is greater than the downward force, and thus the involute wrap side end plate 105 rises up as a whole and presses against the fixed scroll 100 side. Therefore, the end plate 100*a* of the fixed scroll 100 and the end plate 105 of the orbiting scroll 101 are on intimate contact. Thus, gas leakage from between the fixed scroll 100 and the orbiting scroll 101 is inhibited.

However, in the above-described conventional scroll compressor, the revolution of the eccentric axle side end plate 106 of the orbiting scroll 101 must be transmitted to the involute wrap side end plate 105 via the above-described seal member 109. Thus, there is the problem of low transmission efficiency.

Thus, the friction on the seal member 109 becomes severe, and there is the problem that the operation of replacing the seal member 109 requires labor.

Furthermore, as described above, in the conventional scroll compressor, a compressed working gas is used, and the involute wrap side end plate 105 is pressed against the fixed scroll 100 side. However, in particular during operation of the scroll compressor, the compression or the working gas does not become sufficiently high, and thus the force pushing the involute wrap side end plate 105 against the fixed scroll 100 is weak and the compression efficiency is low.

In consideration of the above-described problems, it is an object of the present invention to provide a scroll compressor that transmits rotation of the eccentric axle side end plate 106 of the orbiting scroll to the involute wrap side end plate 105 with good efficiency, and sufficiently presses the involute wrap side end plate 105 continuously against the fixed scroll 100 without causing friction with the seal member 109.

SUMMARY OF THE INVENTION

A first aspect of the present invention is a scroll compressor providing a fixed scroll comprising an end plate and an involute wrap provided on one face of the end plate, and an orbiting scroll comprising and end plate, an engagement part provided on one face of the end plate and accommodating an eccentric axle therein, and an involute wrap provided on the other face of the end face and forming a plurality of compression chambers by the combination with the involute wrap of the fixed scroll, wherein the end plate of the orbiting scroll is divided along the axial direction thereof into an involute wrap side end plate providing an involute wrap and an eccentric axle side end plate providing the engagement part, and furthermore, wherein a transmission mechanism is provided that permits movement of this involute wrap side end plate in the axial direction with respect to the eccentric axle side end plate but prevents movement in the radial or peripheral directions, and transmits the orbital movement of the eccentric axle side end plate to the involute wrap side end plate.

This scroll compressor efficiently transmits the rotation of the eccentric axle side end face to the involute wrap side end face by a transmission means, and can decrease drive loss. Furthermore, because there is no damage to the seal member, maintenance thereof is not necessary.

In particular, preferably the transmission mechanism comprises pin intermitting holes formed parallel to the axial direction on the external perimeter of the involute wrap side end plate and the eccentric axle side end plate and pins fit freely slidably into the pin interfitting holes from the involute wrap side end face or the eccentric side end face side, because the structure will be simplified.

A second aspect of the present invention is a scroll compressor characterized in an elastic member that presses the involute wrap side end face in the direction of the fixed scroll being installed between the involute wrap side end plate and the eccentric axle side end plate.

With this scroll compressor, the involute wrap side end face is continuously pressed against the fixed scroll by the elastic member. That is, a back-pressure applying mechanism that presses the end plate of the orbiting scroll against the fixed scroll side is provided on the orbiting scroll. Thereby, even during the beginning of the operation of the scroll compressor, no leakage of gas from the compression chamber occurs, and thus, the compression efficiency becomes high. Furthermore, with this scroll compressor, both the back-pressure applying mechanism and the transmission mechanism having an axially compliant structure are provided on the orbiting scroll side. When the scroll compressor wherein the fixed scroll as a whole has a floating structure and a back-pressure block is provided on the back face of the fixed scroll is compared to the above-described scroll compressor, in the above-described scroll compressor the high pressure compression chamber can be made compact, and thus the result is a housing having a reduced size. In particular, preferably an inexpensive flat spring can be used as the elastic member.

A third aspect of the invention is a scroll compressor characterized in sealed spaces being formed between the involute wrap side end plate and the eccentric axle side end plate, and furthermore, an introduction hole is formed in order to introduce working gas in the compression chamber to the involute wrap side end plate.

According to this scroll compressor, in addition to the elastic member, the involute wrap side end plate is pressed against the fixed scroll by the working gas in the compression chamber.

In particular, preferably two sealed spaces are formed, and the working gas in the middle-pressure compression chamber is introduced into one sealed space and the working gas in the high-pressure compression chamber is introduced into the other sealed space.

A fourth aspect of the invention is a scroll compressor having a high operation pressure applied, for example, to a refrigeration cycle using carbon dioxide as the working gas.

DESCRIPTION OF THE PREFERRED EMBODIMENTS

Figure 1:
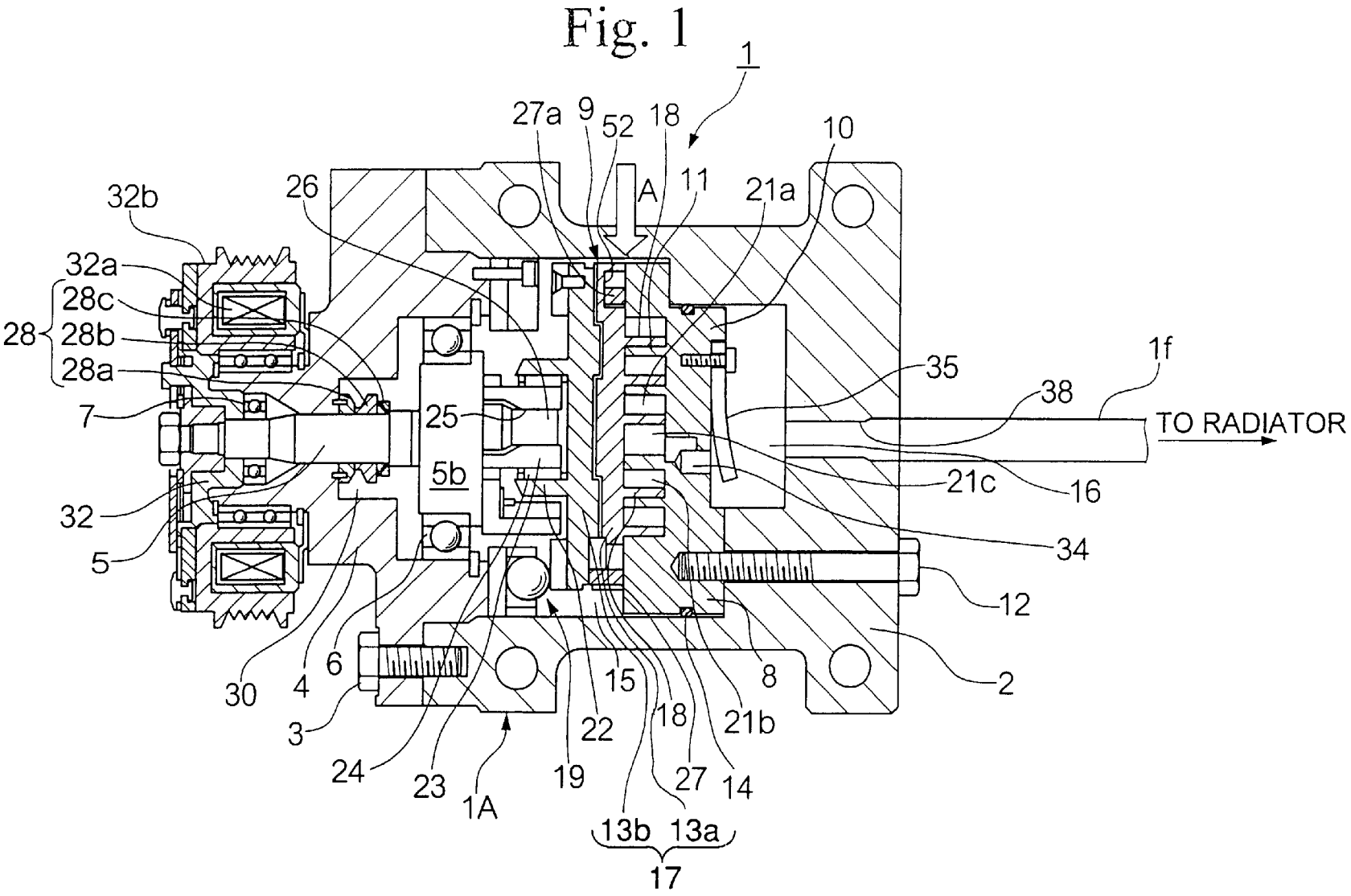
FIG. 1 is a longitudinal cross-sectional drawing showing a first embodiment of the scroll compressor according to the present invention.

Next, an embodiment of the scroll compressor of the present invention will be explained referring to the drawings.

Figure 4:
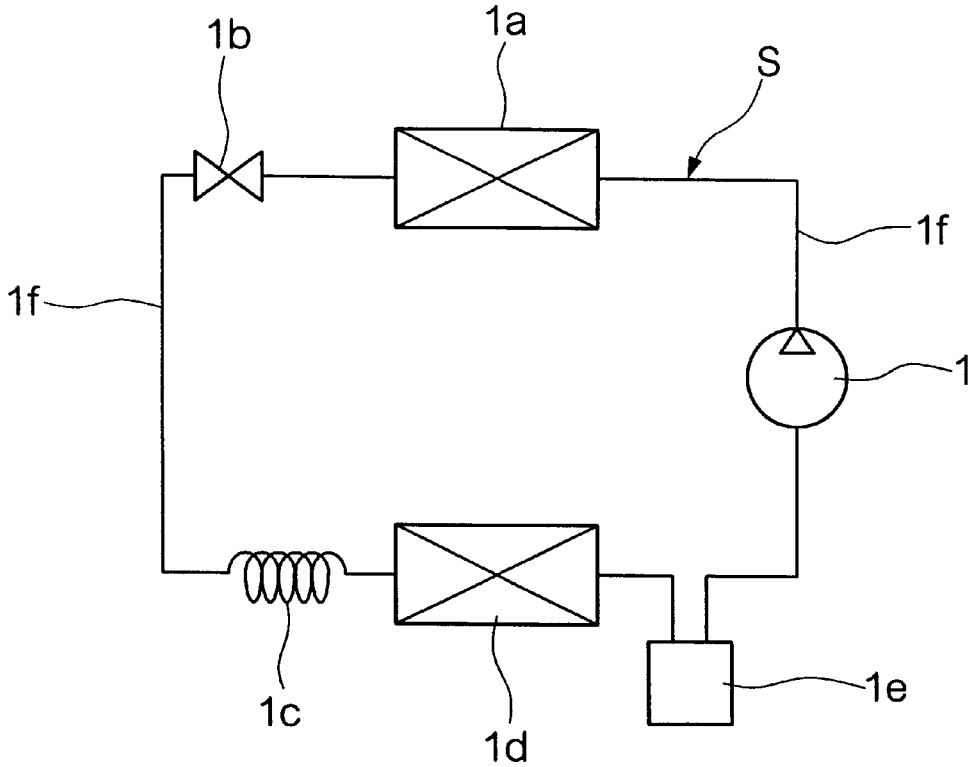
FIG. 4 is a schematic drawing showing a vapor compression type refrigeration cycle.
Figure 5:
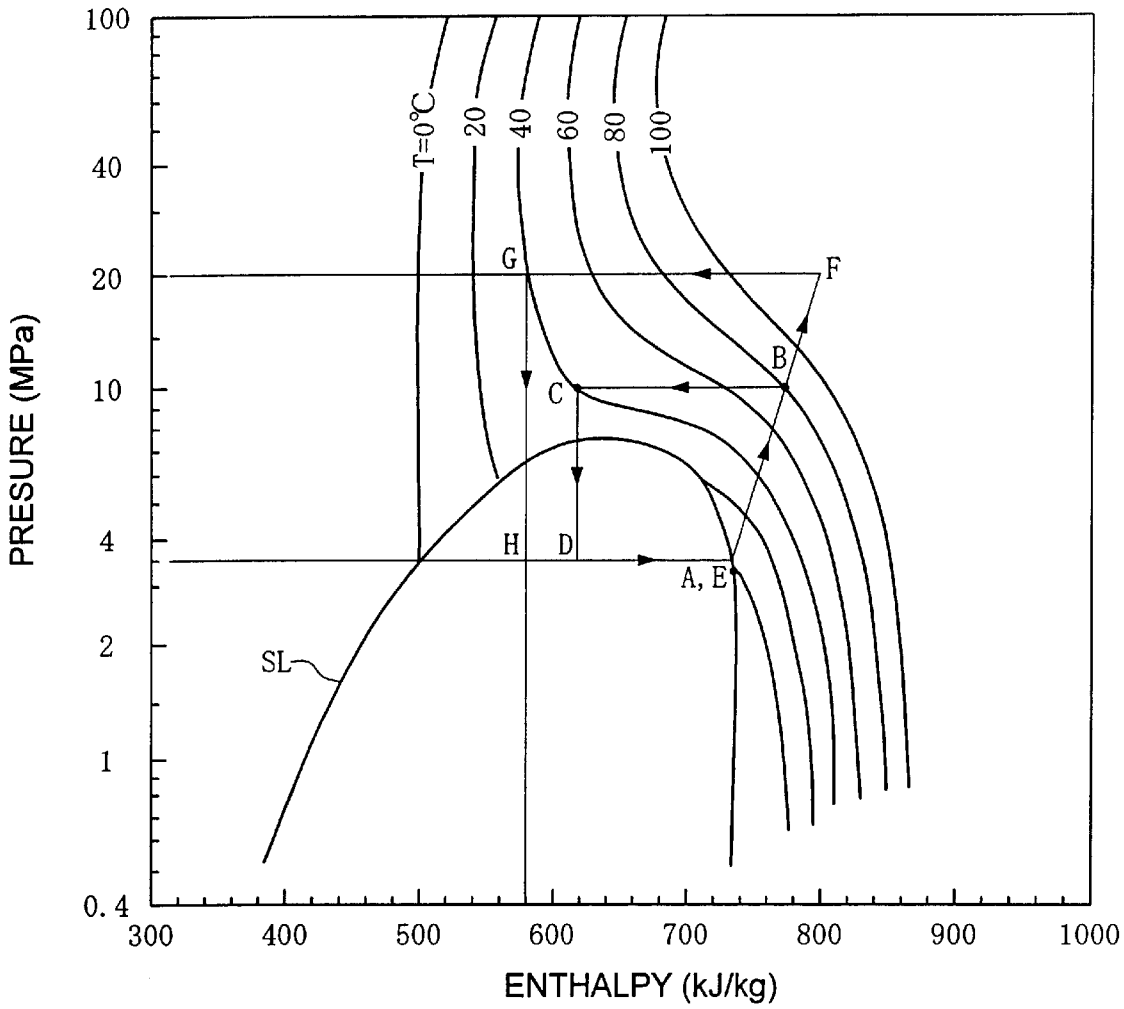
FIG. 5 is a Mollier chart for carbon dioxide.
Figure 6:
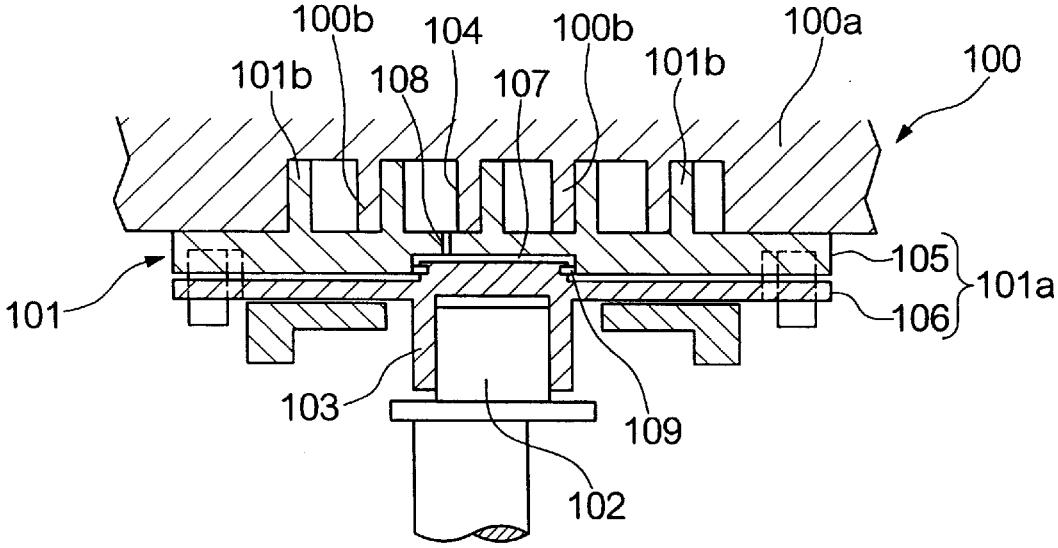
Fig. 6 PRIOR ART
FIG. 6 is a cross-sectional drawing the essential parts of a conventional scroll compressor.

First, please refer to FIG. 4 for the carbon dioxide cycle for the scroll compressor of the present invention. The carbon dioxide cycles shown in FIG. 4 applies, for example, to an air-conditioning system for an automobile.

In FIG. 4, reference numeral 1 denotes the scroll compressor that compresses carbon dioxide that is in a gaseous state. The scroll compressor 1 is driven by receiving drive power from a drive source such as an engine (not illustrated). Reference numeral 1*a* denotes a radiator such as a gas cooler that cools the carbon dioxide that has been compressed by the scroll compressor 1 by heat exchange with the external air. Reference numeral 1*b* denotes a pressure control valve that controls the pressure of the radiator 1*a* outlet side according to the temperature of the carbon dioxide on the radiator 1*a* outlet side. Reference numeral 1*c* is a metering device. The carbon dioxide is decompressed by the pressure control valve 1*b* and the metering device 1*c,* and the carbon dioxide changes to a gas-liquid two-phase state at low temperature and low pressure. Reference numeral 1*d* shows a vaporizer such as a heat sink that serves as an air-cooling mechanism in an automobile cabin. When the liquid-gas two-phase carbon dioxide at low temperature and low pressure is vaporized, that is, evaporated, in the vaporizer, the air in the automobile cabin is cooled by removing the latent heat of vaporization from the air in the automobile cabin. Reference numeral 1*e* denotes an accumulator that temporarily accumulates the gas-phase carbon dioxide. The scroll compressor 1, the radiator 1*a,* the pressure control valve 1*b,* the metering device 1*c,* the vaporizer 1*d,* and the accumulator 1*e* are respectively connected by conduit 1*f* to form a closed system.

Next, a preferred embodiment of the above-described scroll compressor will be explained referring to FIG. 1. The housing (casing) 1A of the scroll compressor 1 is formed by a cup-shaped case body 2 and a front case (crankshaft case) 4 fastened thereto by a bolt 3. The crankshaft 5 passes through the front case 4, and is supported freely-rotatably in the front case 4 via a main bearing 6 and a sub-bearing 7. The revolution of the automobile engine (not illustrated) is transmitted via a well-known electromagnetic clutch 32 to the crankshaft 5. Moreover, reference numerals 32*a* and 32*b* respectively denote the coil and pulley of the electromagnetic clutch 32.

Inside the housing 1A, the orbiting scroll member 9 and the fixed scroll member 8 are disposed. Furthermore, an Oldham ring 27 is installed between the fixed scroll 8 and the orbiting scroll 9 that prevents autorotation of the orbiting scroll 9 and permits orbiting of the orbiting scroll 9 with respect to the fixed scroll 8.

The fixed scroll 8 comprises an end plate 10 and an involute wrap 11 provided on the inside face thereof This end plate 10 is anchored to the case body 2 by a bolt 12. In addition, on the outer peripheral face of the end plate 10, a groove is formed for installing of an O-ring 14, and an O-ring 14 is disposed in this groove. This O-ring 14 is in intimate contact with the inner peripheral face of the case body. Thereby, the inside of the case body 2 is divided into a low pressure chamber (intake chamber) 15 and a high pressure chamber (discharge chamber) 16. Furthermore, on the end plate 10, a discharge port 34 is formed, and a discharge valve 35 is installed for opening and closing this discharge port 34.

The orbiting scroll 9 is formed by an end plate 17 comprising an involute wrap side end plate 13*a* and an eccentric axle side end plate 13*b,* and an involute wrap 18 provided on the inner face thereof. This involute wrap 18 has a form substantially identical to the involute wrap 11 of the fixed scroll 8. The respective involute wraps 18 and 11 of the orbiting scroll 9 and the fixed scroll 8 are installed in the casing 1A so as to be eccentric by the radius of the rotation orbit, and mesh by being offset by a rotation phase by 180°. Thereby, the side faces of the involute wraps 11 and 18 are in intimate contact at a plurality of locations. In addition, the tip seal (not illustrated) installed on the end plate of the involute wrap 11 of fixed scroll 8 is in intimate contact with the inner face of the involute wrap side end plate 13*a* of the orbiting scroll 9. Thereby, a plurality of compression chambers 21*a* and 21*b* that are substantially point symmetrical with respect to the center of the involute wraps 11 and 18 are formed. Moreover, compression chambers 21*a* and 21*b* are middle pressure compression chambers while compression chamber 21*c* is a high pressure compression chamber.

Furthermore, on the center part of the external face of the eccentric axle side end plate 13*b* of the orbiting scroll 9, a cylindrical engagement part (boss) 22 is formed. Inside this engagement part 22, a drive bush 23 is accommodated freely rotatably via an orbiting bearing (drive bearing) 24 that also acts as a radial bearing. Furthermore, an eccentric axle 26 extending from the inner end of the crankshaft 5 is freely rotatably fit in a through hole 25 formed in the drive bush 23. In addition, between the outer peripheral edge of the outer face of the end plate 17 of the orbiting scroll 9 and the front case 4, a thrust ball bearing 19 is disposed in order to support the orbiting scroll 9.

On the external periphery of the crankshaft 5, a mechanical seal 28, which is a well-known shaft seal, is disposed. This mechanical seal 28 is formed from a sheet ring 28*a,* anchored in the front case 4, and a trailing ring 28*b* that rotates with the crankshaft 5. This trailing ring 28*b* is pressed against the sheet ring 28*a* by the urging member 28*c*. Thereby, the trailing ring 28*b* slides with respect to the sheet ring 28*a* along with the rotation of the crankshaft 5.

Below, the characteristic parts of the scroll compressor 1 are explained referring to FIG. 2.

As briefly explained above, the end plate 17 of the orbiting scroll 9 is formed by an involute wrap side end plate 13*a* and an eccentric axle side end plate 13*b* which divide in the axial direction of the orbiting scroll 9. The involute wrap side end plate 13*a* is provided with an involute projection 18 and the eccentric axle side end plate 13*b* is provided with a boss 22 that is an engagement part for the eccentric axle 26.

The involute wrap side end plate 13*a* is attached freely movably on the eccentric axle side end plate 13*b* by a plurality of pins 40*a* on the fixed scroll 10 side. In addition, the rotation of the eccentric axle side end plate 13*b* can be efficiently transmitted to the involute wrap side end plate 13*a* via the plurality of pins 40*a*. More precisely, on the outer peripheral parts of the involute wrap side end plate 13*a* and the eccentric axle side end plate 13*b,* pin interfitting holes 40*b* for insertion of the plurality of the pins 40*a* are formed in parallel in the axial direction. The pins 40*a* are fit into these pin interfitting holes 40*b* freely slidably from the involute wrap side end plate 13*a* to the eccentric axle side end plate 13*b*. A transmission mechanism 40 is formed by these pins 40*a* and pin interfitting holes 40*b*. This transmission mechanism 40 permits the movement of the involute wrap side end plate 13*a* in the axial direction with respect to the eccentric axle side end plate 13*b,* and prevents the movements in the radial and peripheral directions. Furthermore, the orbiting movement of the eccentric axle side end plate 13*b* is transmitted to the involute wrap side end plate 13*a*. Moreover, in this structure, the pins 40*a* can also be inserted contrariwise from the eccentric axle side end plate 13*b* to the involute wrap side end plate 13*a*.

In addition, a flat spring 41 is disposed between the external periphery of the involute wrap side end plate 13*a* and the external periphery of the eccentric axle side end plate 13*b*. This flat spring 41 is an elastic member that pushes the involute wrap side end plate 13*a* against the fixed scroll 8. That is, the involute wrap side end plate 13*a* has an axial direction compliance support structure (floating structure) in its axial direction.

A first sealed space 43 and a second sealed space 44 are formed between the face 14*a* of the involute wrap side end plate 13*a* facing the eccentric axle side end plate 13*b* and the face 14*a* of the eccentric axle side end plate 13*b* facing the involute wrap side end plate 13*a*. More precisely, on the center part of the face 14*a* of the involute wrap side end plate 13*a* a convex part 43*a* is formed. On the center part of the face 14*b* of the eccentric axle side end plate 13*b*, a concave part 43*b* is formed such that a first sealed space 43 is formed having a certain width with respect to the convex part 43*a* of the involute wrap side end plate 13*a*. In addition, an annular concave part 44*a* is formed on the periphery of the convex part 43*a* of the involute wrap side end plate 13*a*. In contrast, on the eccentric axle side end plate 13*b* an annular convex part 44*b* is formed such that a second sealed space 44 is formed having a certain width with respect to the concave part 44*a* of the involute wrap side end plate 13*a*. Furthermore, on the external peripheral step of the convex part 43*a*, a first annular seal 45 having a U-shaped cross-section is formed. Thereby, the above-described sealed space 43 is formed. In addition, similarly, a second annular seal 46 having a U-shaped cross section is attached on the external peripheral step part of the concave part 44*a*. Thus, the above-described sealed space 44 is formed.

Furthermore, on the involute wrap side end plate 13*a*, a high pressure introduction hole 47 for communication between the first sealed space 43 and the high pressure part 21*c* of the compression chamber (refer to FIG. 1) and a middle pressure introduction hole 48 for communication between the second sealed space 44 and the middle pressure part 21*a* (refer to FIG. 1) of the compression chamber are formed. Moreover, the second sealed space 44 an the middle pressure introduction hole 48 need not be provided.

Below, the operation of the scroll compressor 1 will be explained.

Current passes through the coil 32*a* of the electromagnetic clutch 32, and the rotation of the automobile engine is transmitted to the crankshaft 5. Then the rotation of the crankshaft 5 is transmitted to the orbiting scroll member 9 via the orbiting drive mechanism comprising the eccentric axle 26, and through hole 25, the drive bush 23, the orbiting bearing 24, and the boss 22. The orbiting scroll member 9 is prevented from autorotation by the Oldham ring 27, which is an anti-rotation device, and moves in orbital rotation on a circular orbit whose radius is the eccentricity ρ of the eccentric axle 26. Because the orbiting scroll member 9 and the fixed scroll member 8 are disposed eccentrically, the involute wraps 11 and 18 contact each other at a plurality of locations at which the vertical line extending the whole height of the involute wrap 11 of the fixed scroll member 8 is in contact with the vertical line extending the whole height of the involute wrap 18 of the orbiting scroll member 9. Thereby, a plurality of compression spaces 21*a* and 21*b* are formed. When the orbiting scroll member 9 orbits, the contacting locations gradually move toward the centers of the involute wraps 11 and 18. Thereby, as the orbiting scroll member 9 orbits, the compressed spaces 21*a* and 21*b* made by the contacting involute wraps 11 and 18 move towards the center of the involute wraps 11 and 18 while the volume of the compressed spaces 21*a* and 21*b* decreases. Accompanying the above, the working gas that flows to the intake chamber 15 through the intake opening (not illustrated) flows into the sealed space 21*a* from the outer terminal opening part (refer to arrow A in FIG. 1) between both of the involute wraps 11 and 18, and reaches the center part 21*c* while being compressed. From here, the working gas passes through the discharge port 34 formed in the end plate 10 of the fixed scroll member 8, pushes open the discharge valve 35, and is discharged from the high pressure chamber 16. Subsequently, the discharge gas flows out from the discharge opening 38. Thereby, the working gas that is a fluid introduced from the intake chamber 15 due to the orbiting of the orbiting scroll member 9 is compressed in the sealed spaces 21*a* and 21*b*, and the obtained pressurized gas is discharged. The current flowing to the coil 32*a* of the electromagnetic clutch 32 is cut, and when the transmission of the rotational force to the crankshaft 5 ceases, the motion of the open-type compressor 1 is stopped. In addition, the when the current again runs to the coil 32*a* of the electromagnetic clutch 32, the scroll compressor 1 restarts.

Moreover, one part of the working gas that is compressed to high pressure by being compressed in the high pressure part 21*a* of the compression chamber is introduced into the first sealed space 43 via the high pressure introduction hole 47, and fills the space. The amount of high pressure working gas introduced into the first sealed space 43 is set so that the axial pressure applied from the first sealed space 43 to the involute wrap side end plate 13*a* is larger than the maximum value of the axial pressure applied from the compression chamber to the involute wrap side end plate 13*a*. Referring to FIG. 2 to explain this, the amount of the high pressure working gas introduced into the first sealed space 43 is such that the upward pressure applied to the involute wrap side end plate 13*a* from below is larger than the downward pressure applied to the involute wrap side end plate 13*a* from above.

Assuming that the area of the first sealed space 43 is R, and that the high pressure working gas from the high pressure introduction hole 47 is introduced at a discharge pressure Pd, then the force F1 in the upward axial direction acting on the involute warp side end plate 13*a* from the first sealed space 43 is represented by the following equation:

$$F1=(Pd-Ps)\times R$$

(where Ps is the intake pressure).

As explained above, in the involute wrap side end plate 13*a*, not only the upward force, but the pressure from the compression chamber to the involute wrap side end plate 13*a*, that is, the downward force F2, is applied simultaneously. Here, if the area R of the first sealed space 43 is set such that F1>F2, then the involute wrap side end plate 13*a* contributes a back pressure from the first sealed space 43, and is pressed against the fixed scroll 8. The second sealed space 44 acts in the same manner as the first sealed space 43. As a result, the tip seal (not illustrated) embedded in the end face of the involute wrap 11 of the fixed scroll 8 comes into intimate contact with the inside of the end plate 17 of the orbiting scroll 9. Simultaneously, the tip seal (not illustrated) embedded in the end face of the involute wrap 18 of the orbiting scroll 9 also becomes in intimate contact with the inside of the end plate 10 of the fixed scroll 8, and the leakage of the working gas from the compression spaces is prevented.

In the present embodiment, the rotation of the eccentric axle side end plate 13*b* of the orbiting scroll 9 is efficiently transmitted to the involute wrap side end plate 13*a* via the transmission means 40 comprising a plurality of pins 40*a* and pin holes 40*b* into which these pins 40*a* are inserted.

In addition, in particular during operation of the scroll compressor 1, the pressure of the compressed working gas does not become sufficiently high. Due to this, the effect of the pack pressure application that presses the involute side end plate 13*a* against the fixed scroll 10 is low. However, even in this sort of case, the flat spring 41 continuously presses the involute wrap side end late 13*a* against the fixed scroll 8, and thereby leakage of the working gas is reliably prevented, and thus the compression efficiency can be improved.

Furthermore, both the pack pressure application structure in which, in the orbiting scroll 9, the involute wrap side end plate 13*a* of the orbiting scroll 9 is pressed against the fixed scroll 10 side and the axial compliance structure were used. The fixed scroll 10 as a whole was given a floating structure, and because the fixed scroll 10 is made to be in intimate contact with the orbiting scroll 9, when the scroll compressor provided with back pressure block on the back face of the fixed scroll 10 is compared to the scroll compressor of the present embodiment, the scroll compressor of the present embodiment has the advantages that the high pressure chamber can be made smaller, and as a result the housing can be reduced in size.

Figure 3A:
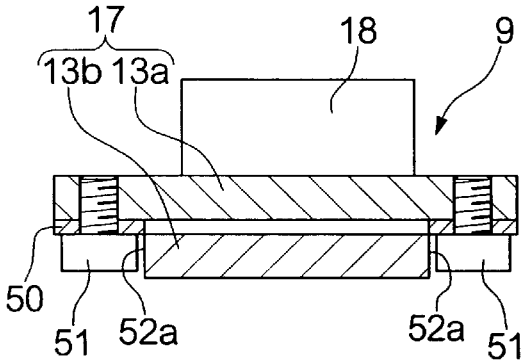
FIGS. 3A and 3B are cross-sectional drawings showing another example of an orbiting scroll, and show the orbiting scroll cut in mutually orthogonal directions.
Figure 3B:
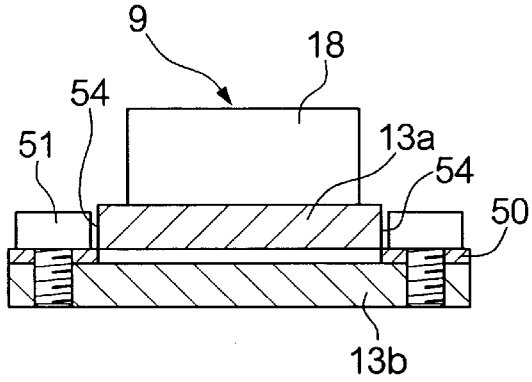
Figure 3C:
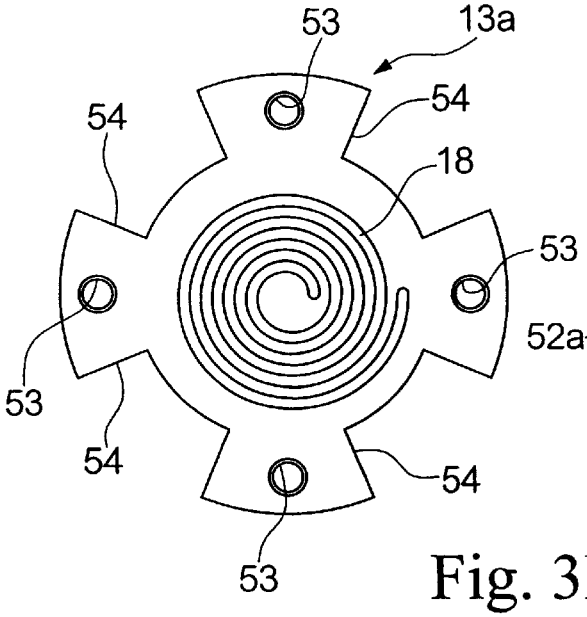
FIGS. 3C, 3D, and 3E are drawings showing another example of the orbiting scroll, and are respectively a planar drawing showing the involute wrap side end plate, a planar drawing showing the eccentric axle side end plate, and a planar drawing showing the flat spring.

FIGS. 3A and 3B are drawings for showing another example of the axial compliance support structure (floating structure) preferably used on the involute wrap side end plate 13*a*. These are cross-sectional drawings showing the orbiting scroll 9 when cut in mutually perpendicular directions. Between the involute wrap side end plate 13*a* shown in FIG. 3C and the eccentric axle side end plate 13*b* shown in FIG. 3D, the ring-shaped flat spring 50 shown in FIG. 3E is provided as an elastic member. This flat spring 50 is disposed between the involute wrap side end plate 13*a* and the eccentric axle side end plate 13*b*, and then a plurality of bolts 51 are anchored by being inserted alternately in the peripheral direction from the involute wrap side end plate 13*a* and the eccentric axle side end plate 13*b*.

Figure 3D:
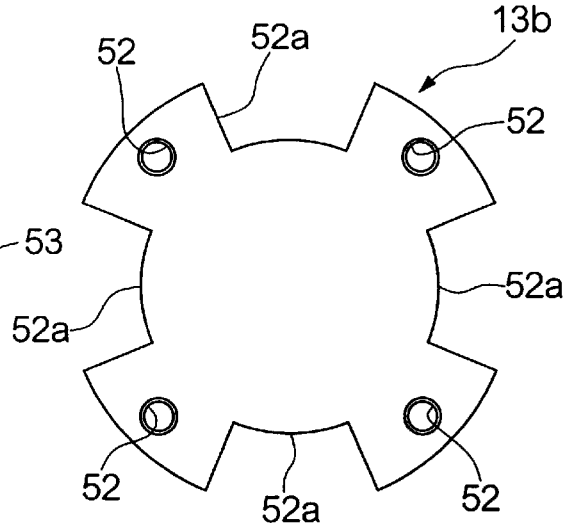
Figure 3E:
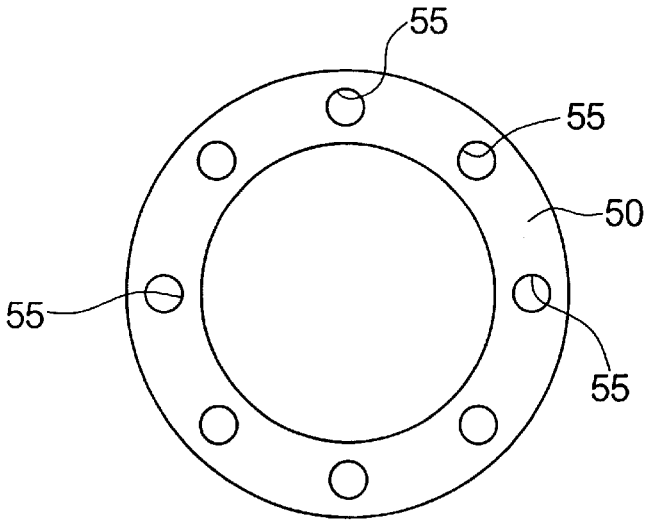

More precisely, as shown in FIG. 3D, on the outside peripheral portion of the eccentric axle side end plate 13*b*, a plurality of screw holes 52 (four in this example), are formed at equal intervals along the peripheral direction. Furthermore, between a screw hole 52 and a screw hole 52, a notch 52*a* is formed in order to prevent the screw holes 52 formed on the involute wrap side end plate 13*a* from being covered when the involute wrap side end plate 13*a* and the eccentric axle side end plate 13*b* are displaced over one another.

In addition, as shown in FIG. 3C, on the outside peripheral portion of the involute wrap side end plate 13*a*, a plurality of screw holes 53 (four in this example) are formed at equal intervals along the peripheral direction. Furthermore, between the screw hole 53 and screw hole 53, a notch 54 is formed in order to prevent the screw holes 52 formed on the eccentric axle side end plate 13*b* from being covered when the involute wrap side end plate 13*a* and the eccentric axle side end plate 13*b* are disposed over one another.

Furthermore, as shown in FIG. 3E, on the flat spring 50, through holes 55 are formed at eight equal intervals in the peripheral direction conforming to the screw holes 53 formed on the involute wrap side end plate 13*a* and the screw holes 52 formed on the eccentric axle side end plate 13*b*.

The eight bolts 51 pass through the through holes 55 of the flat spring 50 from alternately opposite directions, that is, the bolts 51 are inserted alternating from the involute wrap side end plate 13*a* and then from the eccentric axle side end plate 13*b*. In other words, in each screw hole 52 of the eccentric axle side end plate 13*b*, the bolts 51 are inserted and engaged from the involute wrap side end plate 13*a*. Additionally, in the screw holes 53 of the involute wrap side end plate 13*a*, the bolts 51 are inserted and engaged from the eccentric axle side end plate 13*b*.

By using this structure, the involute wrap side end plate 13*a* can be moved with respect to the eccentric axle side end plate 13*b* in the axial direction up to the limit of the flexible tolerance of the flat spring 50. The rotation of the eccentric axle side end plate 13*b* is transmitted to the involute wrap side end plate 13*a* via the transmission mechanism comprising the bolts 51 and the flat spring 50.

Figure 2:
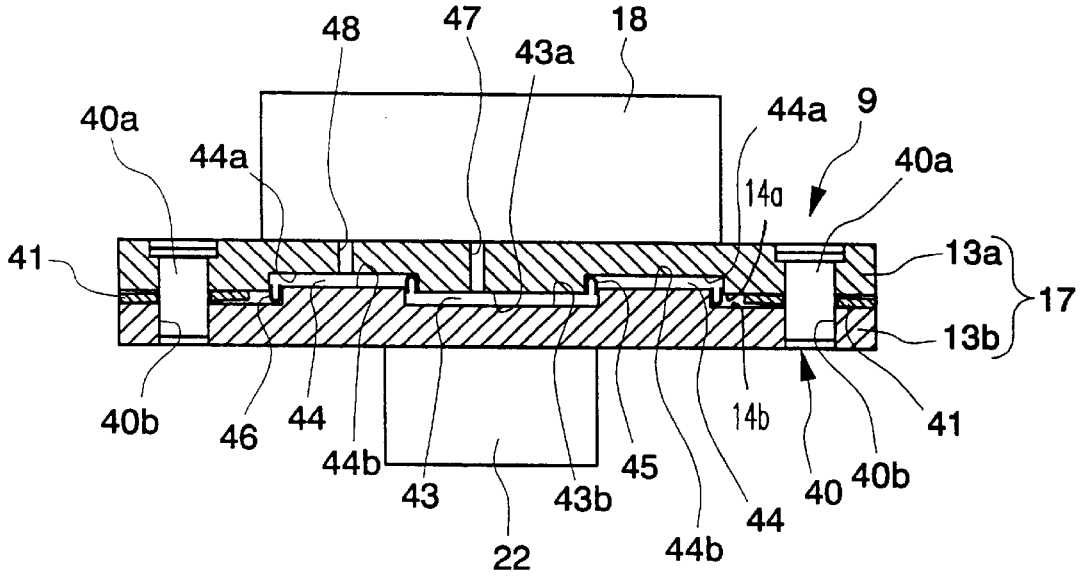
FIG. 2 is an enlarged cross-sectional drawing of the orbiting scroll shown in FIG. 1.

Moreover, in FIG. 3A to FIG. 3C, the sealed space and the high pressure introduction holes formed between the involute wrap side end plate 13*a* and the eccentric axle side end plate 13*b* are the same as those in FIG. 2, and are not illustrated.

Furthermore, in the above-described embodiment, a carbon dioxide cycle using carbon dioxide as a working gas is adopted in an open compressor, but the invention is not limited thereby, and can be applied to a vapor compression refrigeration cycle using a typical working gas such as Freon.

What is claimed is:

1. A scroll compressor comprising:

a fixed scroll including an end plate and an involute wrap provided on one face of the end plate of the fixed scroll;

an orbiting scroll including an end plate including an involute wrap side end plate and an eccentric axle side end plate, the eccentric axle side end plate having an engagement part provided on one face and accommodating an eccentric axle therein, and the involute wrap side end plate having an involute wrap forming a plurality of compression chambers with the involute wrap of the fixed scroll;

transmission means for transmitting orbital movement of the eccentric axle side end plate to the involute wrap side end plate; and a flat spring configured to urge the involute wrap side end plate toward the fixed scroll and installed between the involute wrap side end plate and the eccentric axle side end plate.

2. A scroll compressor according to claim 1, wherein said transmission means includes a plurality of pin interfitting holes formed parallel to the axial direction on a perimeter of the involute wrap side end plate and the eccentric axle side end plate and a plurality of pins each configured to fit freely slidably into a respective one of the plurality of pin interfitting holes from at least one of the involute wrap side end plate and the eccentric side end face side.

3. A scroll compressor according to claim 2, wherein the working gas is carbon dioxide.

4. A scroll compressor according to claim 1, wherein:

said involute wrap side end plate and the eccentric axle side end plate form a plurality of sealed spaces; and the involute wrap side end plate has an introduction hole configured to introduce working gas in the compression chamber.

5. A scroll compressor according to claim 4, wherein:

said plurality of sealed spaces comprises two seal spaces; and one of the two seal spaces is configured to introduce the working gas in the middle-pressure compression chamber and other one of the two seal spaces is configured to introduce the working gas in the high-pressure compression chambers.

6. A scroll compressor comprising:

a fixed scroll including an end plate and an involute wrap provided on one face of the end plate of the fixed scroll;

an orbiting scroll including an end plate including an involute wrap side end plate and an eccentric axle side end plate, the eccentric axle side end plate having an engagement part provided on one face and accommodating an eccentric axle therein, and the involute wrap side end plate having an involute wrap forming a plurality of compression chambers with the involute wrap of the fixed scroll;

a transmission mechanism configured to allow the involute wrap side end plate to move in an axial direction of the eccentric axle and prevent the involute wrap side end plate from moving in a radial direction while transmitting orbital movement of the eccentric axle side end plate to the involute wrap side end plate; and a flat spring configured to urge the involute wrap side end plate toward the fixed scroll and installed between the involute wrap side end plate and the eccentric axle side end plate.

7. A scroll compressor according to claim 6, wherein said transmission mechanism comprises a plurality of pin interfitting holes formed parallel to the axial direction on a perimeter of the involute wrap side end plate and the eccentric axle side end plate and a plurality of pins each configured to fit freely slidably into a respective one of the plurality of pin intermitting holes from at least one of the involute wrap side end plate and the eccentric side end face side.

8. A scroll compressor according to claim 6, wherein the working gas is carbon dioxide.

9. A scroll compressor according to claim 6, wherein:

said involute wrap side end plate and the eccentric axle side end plate form a plurality of sealed spaces; and the involute wrap side end plate has an introduction hole configured to introduce working gas in the compression chamber.

10. A scroll compressor according to claim 9, wherein:

said plurality of sealed spaces comprises two seal spaces; and one of the two seal spaces is configured to introduce the working gas in the middle-pressure compression chamber and other one of the two seal spaces is configured to introduce the working gas in the high-pressure compression chambers.

* * * * *